United States Patent [19]

Curtis

[11] 4,022,702

[45] May 10, 1977

[54] PRODUCTION OF DETERGENT COMPOSITIONS CONTAINING CALCIUM CARBONATE

[75] Inventor: Michael Curtis, Heswall, England

[73] Assignee: Lever Brothers Company, New York, N.Y.

[22] Filed: May 28, 1975

[21] Appl. No.: 581,409

[30] Foreign Application Priority Data

May 30, 1974 United Kingdom ..... 23949/74

[52] U.S. Cl. ..... 252/89 R; 252/131; 252/135; 252/140; 252/529; 252/539; 252/550

[51] Int. Cl.[2] ..... C11D 3/10; C11D 3/12; C11D 11/02; C11D 13/01

[58] Field of Search ..... 252/99, 131, 135, 140, 252/89, 529, 539, 550

[56] References Cited

UNITED STATES PATENTS

| | | | |
|---|---|---|---|
| 2,829,110 | 4/1958 | Robson | 252/103 X |
| 3,843,563 | 10/1974 | Davies | 252/547 |
| 3,865,754 | 2/1975 | Norris | 252/532 |
| 3,957,695 | 5/1976 | Davies | 252/532 |
| 3,979,314 | 9/1976 | Child | 252/140 |

FOREIGN PATENTS OR APPLICATIONS

| | | | |
|---|---|---|---|
| 2,321,001 | 11/1973 | Germany | 252/131 |

*Primary Examiner*—Dennis L. Albrecht
*Attorney, Agent, or Firm*—Kenneth F. Dusyn; James J. Farrell; Melvin H. Kurtz

[57] ABSTRACT

Particulate detergent compositions which comprise a detergent compound, an alkali metal carbonate detergency builder and finely divided calcium carbonate having a surface area of at least about 5 $m^2/g$, are made with improved properties, by using a process in which the calcium carbonate is dispersed in water to which at least some of the detergent compound is added, after which the alkali metal carbonate is added to form a detergent slurry which is then spray-dried to form the detergent composition.

5 Claims, No Drawings

PRODUCTION OF DETERGENT COMPOSITIONS CONTAINING CALCIUM CARBONATE

The present invention relates to the production of detergent compositions, and in particular to the production of spray dried particulate detergent compositions which are intended for fabric washing.

Fabric washing detergent compositions commonly incorporate as the major ingredients one or more detergent active compounds and a so-called detergency builder. Conventional detergency builders are commonly inorganic materials, particularly the condensed phosphates, for example sodium tripolyphosphate. It has, however, been suggested that the use of these phosphate detergency builders can contribute to eutrophication problems. Alternative detergency builders which have been proposed, for example sodium nitrilotriacetate (NTA) and synthetic polymeric polyelectrolyte materials, tend to be more expensive or less efficient than the phosphate detergency builders, or otherwise unsatisfactory for one reason or another.

It is known that sodium carbonate can function as a detergency builder by removing the calcium from hard water in the form of precipitated calcium carbonate. But such calcium carbonate tends to accumulate on washing machine surfaces and on washed fabrics, and this can lead to fabric harshness.

In the specification of our U.S. patent application No. 386,827, now U.S. Pat. No. 3,957,695 issued May 18, 1976, we have described detergent compositions which are based on an alkali metal carbonate detergency builder and which also contain an amount of finely divided calcium carbonate. These compositions tend to form less inorganic deposites on washed fabrics and hence give decreased fabric harshness, apparently because the precipitated calcium carbonate is deposited on the added calcium carbonate instead of on the fabrics or washing machines. Moreover, by encouraging the calcium hardness in the wash water to be removed from solution in this way the detergencies of the compositions are improved, compared with those detergent compositions in which inorganic deposition on the fabrics is decreased by inhibition of the precipitation process, either by the addition of anti-deposition agents or by the action of precipitation inhibitors which we have found to be present in wash liquors. The added calcium carbonate also appears to act as a scavenger for the calcium carbonate precipitation inhibitors, which facilitates the nucleation process and further increases the effect of its presence.

The new detergent compositions based on an alkali metal carbonate detergency builder and finely divided calcium carbonate can be made by simple admixture of the ingredients. However, we have now found a particularly advantageous method of making such detergent compositions in particulate form, in which process the calcium carbonate is firstly dispersed in water to which at least some of the detergent compound is added, after which the alkali metal carbonate and any balance of the detergent compound and optionally other detergent ingredients are added so as to form a slurry which is than spray dried to form the particulate detergent composition. The amount of the detergent compound added to the slurry before the calcium carbonate is from 5 to 100% by weight of the total detergent compound in the composition. The use of this order of addition of the ingredients when forming the aqueous detergent slurry improves the properties of the resultant detergent compositions, especially in improving the dispersibility of the calcium carbonate, and it provides the resultant compositions with improved detergency. In conventional slurry making processes the ingredients which have the greatest effect on slurry viscosity, in this case the calcium carbonate, are added last, but when this is applied to the alkali metal carbonate-built compositions with added finely divided calcium carbonate, the resultant products are not as good as would be desired.

The amounts and types of the alkali metal carbonate used are the same as in the complete specification of our aforementioned patent application Ser. No. 386,827, now U.S. Pat. No. 3,957,695 issured May 18, 1976. More specifically, the alkali metal carbonate used is preferably sodium or potassium carbonate or a mixture thereof, for reasons of cost and efficiency. The carbonate salt is preferably fully neutralised, but it may be partially neutralised, for example a sesquicarbonate may be used in partial replacement of the normal carbonate salt; the partial salts are less alkaline and therefore less efficient. The amount of the alkali metal carbonate in the detergent composition can be varied widely. but the amount should be at least about 10% by weight, preferably from about 20 to about 60% by weight, though an amount of up to about 75% could possibly be used if desired in special products. The amount of the alkali metal carbonate is determined on an anhydrous basis, though the salts may be hydrated either before or when incorporated into the detergent composition. It should be mentioned that within the preferred range the higher levels tend to be required under conditions of use at low product concentrations, as is commonly the practice in North America, and the converse applies under conditions of use at higher product concentrations, as tends to occur in Europe. It should be noted that it may also be desirable to limit the carbonate content to a lower level within the range mentioned, so as to decrease the risk of internal damage following any accidental ingestion for example by children.

The calcium carbonate used should be finely divided, and should have a surface area of at least about 5 square meters per gram (5 $m^2/g$), generally at least about 10 $m^2/g$, and preferably at least about 20 $m^2/g$. The particularly preferred calcium carbonate has a surface area of from about 30 to about 100 $m^2/g$, especially about 50 to about 85 $m^2/g$. Calcium carbonate with surface areas in excess of about 100 $m^2/g$ could be used, up to say about 150 $m^2/g$, if such materials are economically available, but it appears to be unlikely that any higher specific surface areas (i.e. per gram) will be achievable commercially and this may in any case be undesirable for other reasons, for example especially small particles, i.e. with very high specific surface areas, may have a tendency to dissolve during the washing process and there may be dust problems.

As an indication of the general relationship between particle size and surface area, we have found that calcite with a surface area of about 50 $m^2/g$ has an average primary crystal size (diameter) of about 250 Angstrom (A), whilst if the primary crystal size is decreased to about 150 the surface area increases to about 80 $m^2/g$. In practice some aggregation takes place to form larger particles. It is desirable that the aggregated particle size of the calcium carbonate should be fairly uniform, and in particular that there should be no appreciable quantity of large particles which would get trapped in the fabrics being washed.

Surface areas are determined by the standard Brunauer, Emmet and Teller (BET) method, using an AREA-meter made by Strohlein & Co, and operated according to the suppliers' instruction manual. The procedure for degassing the samples under investigation is usually left to the operator, but we have found that a degassing procedure in which the samples are heated for 2 hours at 175° C under a stream of dry nitrogen is effective to give repeatable results.

It should be mentioned that the calcium carbonate may be absorbed onto a substrate, in which case it may not be possible to measure accurately the surface area of the calcium carbonate alone. The effective surface area can then be calculated by checking the effectiveness of the calcium carbonate and relating this to the effectiveness of calcium carbonates of known surface areas. Alternatively, it may be possible to use electron microscopy to determine the average particle size, from which an indication of surface area might be obtained, but this should still be checked by determining the effectiveness of the calcium carbonate in use.

Any crystalline form of calcium carbonate may be used or mixtures thereof, but calcite is preferred, as aragonite and vaterite appear to be more difficult to prepare with high surface areas, and it appears that calcite is a little less soluble than aragonite or vaterite at most usual wash temperatures. When any aragonite or vaterite is used, it is generally in admixture with calcite. Calcium carbonate can be prepared conveniently by precipitation processes, for example by passing carbon dioxide into a suspension of calcium hydroxide, in which case it may be convenient to use the resultant wet calcium carbonate when preparing the detergent composition, as drying the calcium carbonate may tend to encourage aggregation of the calcium carbonate particles which decreases their efficiency. Other chemical precipitation reactions may be employed to produce the calcium carbonate especially the reaction between any soluble calcium salt and any soluble carbonate salt, for example by reaction between calcium sulphate or calcium hydroxide and sodium carbonate, but these reactions form aqueous slurries containing undesirable dissolved salts, i.e. sodium sulphate and sodium hydroxide in the samples mentioned, which means that the calcium carbonate would have to be filtered from the slurry and washed before use unless the dissolved salts could be tolerated in the detergent compositions. Finely divided calcium carbonate may also be prepared by grinding minerals such as limestone or chalk, but this is not effective as it is difficult to obtain a high-enough surface area. Suitable forms of calcium carbonate, especially calcite, are commercially available. The calcium carbonate is preferably in substantially pure form, but this is not essential and the calcium carbonate used may contain minor amounts of other cations with or without other anions or water molecules.

The amount of calcium carbonate used in the compositions should be from about 5% and preferably at least about 10 up to about 60%, more preferably from about 10 to about 40%, by weight of the detergent compositions. Within the broad range, the lower levels of calcium carbonate may be satisfactory under certain conditions of use and with particularly effective calcium carbonates. However, with less effective calcium carbonates, and especially under conditions of use at low product concentration, as for example under typical North American washing conditions, it is preferred to use higher levels of calcium carbonate within the preferred range mentioned. The specific surface area of the calcium carbonate very markedly affects its properties, with high specific surface area materials being more effective, so that lower amounts of such materials can be used to good effect in comparison with calcium carbonates of low specific surface area.

The calcium carbonate may be incorporated into the slurry in either powder or paste form. The latter is generally preferred as it avoids the cost of drying the calcium carbonate after its production by precipitation, and the properties of the calcium carbonate also tend to be better if it is not dried before the slurry making step because drying encourages aggregation of the calcium carbonate particles. However, if the calcium carbonate is dried before slurry making it possible to treat it with a dispersing aid as described in the specification of our U.S. patent applications Nos. 497,424 and 497,425, now U.S. Pat. No. 3,979,314 issued Sept. 7, 1976.

It is also essential to use in the detergent compositions made by the process of the present invention one or more anionic, nonionic, amphoteric or zwitterionic detergent compounds, the amounts and types of which are the same as in our first afore-mentioned patent application. It is preferred to use from about 5 to about 40% of a detergent compound which does not during use form an insoluble calcium salt, which would of course result in a substantial decrease in detergency properties. Many suitable detergent compounds are commercially available and are fully described in the literature, for example in "Surface Active Agents and Detergents", Volumes 1 and 2 by Schwartz, Perry and Berch.

Additionally, it is desirable but not essential to incorporate into the detergent slurries additives which tend to decrease slurry viscosity, so as to facilitate the pumping and atomising of the slurry, and also because this can enable some reduction in the water content, which of course improves the economics of the process by decreasing the heat required to dry the slurry to form the detergent powder. Examples of slurry viscosity decreasing additives include sodium toluene sulphonate and some nonionic compounds, such as coconut monoethanolamide and linear-sec alkyl ($C_{11}$–$C_{15}$) – 9 EO condensate, which are preferably used at levels of about 0.5 to about 5% by weight, e.g., about 1 to about 3% by weight, of the compositions.

In addition to the essential ingredients mentioned above, it is permissible to include in the detergent slurry any of the optional detergent ingredients which are conventionally added to detergent compositions. Such optional ingredients are generally the same as those set out in the complete specification of our first afore-mentioned patent application. Principal amongst such additives is sodium silicate which improves the properties of the detergent compositions, both as regards detergency and powder structure, and it is preferred to use about 5 to 15% of sodium alkaline or neutral silicate. It should also be noted that the presence of condensed phosphates have a deleterious effect on the properties of the compositions as they interfere with the precipitation of calcium carbonate; it is therefore preferred to have a maximum level of about 0.05% P, which is equivalent to about 0.2% sodium tripolyphosphate.

The slurry making and spray drying steps in the process of the present invention may be done in conventional equipment for this purpose, for example in crutcher, paddle or turbomixers and spray drying towers. The slurry making equipment should of course be capable of thoroughly dispersing the calcium carbonate in the water. Normal temperatures are used for these operations, for example about 30° to about 100° C, preferably about 70° to about 90° C, for the slurry making and about 200° to about 450° C for the drying gas inlet in the spray drying process, with higher temperatures in this range being preferred for economic reasons.

After the spray drying step, the powder may be further dried if desired, for example in a fluidised bed, after which it may have added to it other detergent ingredients, particularly such ingredients which are heat-sensitive and cannot be readily added to the slurry without degrading or being otherwise deleteriously affected in the spray drying step, for example oxygen bleaching agents such as sodium perborate, and enzymes. Alternatively, the spray dried powder made by the process of the invention may itself be added to a separately prepared detergent base powder, as a way of incorporating the finely divided calcium carbonate into a detergent composition.

The invention is illustrated in more detail by the following Examples in which parts and percentages are by weight, except where otherwise indicated.

EXAMPLE 1

Three detergent compositions were made to the following nominal formulation:

| Ingredient | % |
|---|---|
| Sodium linear-sec alkyl ($C_{11}$–$C_{15}$) benzene sulphonate | 16.0 |
| Calcite[1] | 30.0 |
| Sodium toluene sulphonate | 2.0 |
| Sodium alkaline silicate | 8.0 |
| Sodium carbonate | 35.0 |
| Fluorescent agents, SCMC | 1.0 |
| Water (and sodium sulphate) | to 100.0 |

[1]Calofort U50, supplied by J.E. Sturge Limited, Birmingham, England, having an average primary crystal size of about 260 A, and a nominal surface area of about 50 $m^2/g$ (35–45 $m^2/g$ determined by BET method on different batches).

All of the compositions were made by slurry making followed by spray drying, but the order of addition of the ingredients to the slurry was varied as follows:

COMPOSITION A

Water first, followed by the detergent active compound in paste form, then the calcite in powder form and finally all the other ingredients in the order shown in the formulation above.

COMPOSITION B

Water first, followed by the calcite, and then the other ingredients in the order shown except that the detergent active compound was added last.

COMPOSITION C

Waterfirst followed by the detergent active compound, and the other ingredients in the order shown except for the calcite which was added last.

In the case of composition B it was found that extra water was needed to disperse the calcite thoroughly (about 50% on the slurry), whereas with the other compositions A and C, a normal water content of about 43% in the slurry was adequate. In each case the following process conditions were used:

| | |
|---|---|
| Slurry temperature | 80° C |
| Tower air inlet temperature | 300°–350° C |
| Tower outlet temperature | 100°–120° C |
| Slurry throughput | 500 Kg/hr |
| Slurry pressure | 55 $Kg/cm^2$ |

It was found in subsequent evaluation tests, that in composition A the calcite had not aggregated as much as in compositions B and C, which resulted in better detergency properties (as measured by calcium ion concentration with less tendency for the calcite to deposit onto washed fabrics (as measured by black cloth filtration of wash liquors). In the test to assess detergency properties, the compositions are dispersed in hard water and then the free calcium and magnesium ion concentrations are measured using standard procedures. In the black cloth filtration test the aqueous dispersion of the compositions are filtered through black cotton twill close weave cloths and the amounts of calcium carbonate deposited are then graded on a whiteness scale as follows:

0 — no deposit
1 — trace of deposit
2 — light deposit
3 — moderate deposit
4 — heavy deposit
5 — very heavy deposit In this severe test gradings of 0 or 1 are not normally achievable, and gradings of 2 or 3 are acceptable in practice.

The evaluation test results for compositions A, B and C were as follows:

| Composition | Black Cloth Grading | Detergency effect $Ca^{++}(M \times 10^{-4})$ | $Mg^{++}(M \times 10^{-4})$ |
|---|---|---|---|
| A | 3 | 1.5 | 1.3 |
| B | 4 | 1.9 | 1.7 |
| C | 5 | 2.8 | 2.0 |

These results show the product benefits of using the process according to the invention.

EXAMPLE 2

A powdered detergent composition was made to the following nominal formulation:

| Ingredient | % |
|---|---|
| Sodium linear sec-alkyl ($C_{14}$–$C_{15}$) sulphate | 7.0 |
| Tallow alcohol - 18 EO | 2.0 |
| Sodium tallow soap | 3.0 |
| Calcite[1] | 15.0 |
| Sodium toluene sulphonate | 2.0 |
| Sodium carbonate | 30.0 |
| Minor ingredients (preservatives, fluorescers, etc) | 0.5 |
| Sodium alkaline silicate | 10.0 |
| Sodium sulphate | 4.5 |
| Sodium perborate | 20.0 |
| Water | to 100.0 |

[1]The calcite had a nominal surface area of about 80 $m^2/g$, and was supplied in the form of a 30% solids filter cake by solvay et Cie.

The composition was made by admixing the ingredients in the order shown above except for the sodium perborate which was post-dosed to the spray dried base powder, and the water. The latter was in fact added first to a crutcher mixer to which the other ingredients wer than added to form a detergent slurry having a moisture content of about 45%, with a final slurry temperature of about 75° C. The slurry was spray dried in a countercurrent spray drying tower with an air inlet temperature of about 315° C and an outlet temperature of about 100° C. The resultant powder had satisfactory bulk density, particle size, compressibility and friability properties. Comparative tests showed that the presence of the sodium toluene sulphonate was particularly valuable in decreasing slurry viscosity and hence in decreasing slurry water content, and also that the presence of at least 10% of sodium alkaline or neutral silicate is particularly beneficial for the physical properties of the powder.

The detergent composition was found to have good lather, stain removal and detergency properties with acceptable low inorganic deposition on washed fabrics.

EXAMPLE 3

A detergent composition was prepared to the following nominal formulation:

| Ingredient | % |
|---|---|
| Sodium linear-sec alkyl ($C_{11}$–$C_{15}$) benzene sulphonate | 15.0 |
| Sodium linear sec-alkyl ($C_{14}$–$C_{15}$) sulphate | 1.5 |
| Sodium alkaline silicate | 10.0 |
| Sodium carbonate | 45.0 |
| Calcite (as used in Example 2) | 15.0 |
| Sodium toluene sulphonate | 1.5 |
| Minor ingredients (preservatives, fluorescent agents etc) | 2.0 |
| Water | 10.0 |

This composition was prepared by admixture of two separately spray dried base powders A and B, having the following nominal formulations:

| A | |
|---|---|
| Ingredient | % |
| Sodium alkyl benzene sulphonate | 15.0 |
| Sodium silicate | 10.0 |
| Sodium toluene sulphonate | 1.5 |
| Sodium carbonate | 15.0 |
| Minor ingredients | 2.0 |
| Water | 5.0 |
| | 48.5 |

| B | |
|---|---|
| Ingredient | % |
| Sodium alkyl sulphate | 1.5 |
| Calcite | 15.0 |
| Sodium carbonate | 30.0 |
| Water | 5.0 |
| | 51.5 |

Both base powders A and B were made by normal slurry making and spray drying techniques, except for the order of addition of the ingredients which were in the order shown above except that the water was added first. The slurry moisture contents for both base powders A and B were, respectively, about 35% and about 45%, with slurry temperatures about 90° C. The spray drying temperatures were about the same as in Example 2. Both base powders A and B were free flowing and had satisfactory densities.

The resultant mixed detergent compositions comprising both parts A and B, was evaluated for detergency and inorganic deposition and found to be satisfactory in both these respects, and better than a comparative powder in which part B is made using a different order of addition of the ingredients to the slurry wherein the calcite is added last. The composition made according to the invention was found to be comparable in detergency properties with a commercially available product containing 33% sodium tripolyphospate.

What is claimed is:

1. In a process for making a particulate detergent composition comprising from about 5 to about 40% of a detergent surface active compound selected from the group consisting of an anionic active which does not form an insoluble calcium salt during use, an amphoteric active, a zwitterionic active and mixtures thereof; from about 10 to about 75% of an alkali metal carbonate detergency builder; and from about 5 to about 60% of finely divided calcium carbonate having a surface area of at least about 5m²/g, the percentages being by weight of the total composition, the improvement whereby the calcium carbonate is dispersed in water to which from 5 to 100% of the detergent surface active compound is added, this percentage being by weight of the total detergent active compound in on the resultant composition, after which the alkali metal carbonate is added to form a detergent slurry which is then spray dried to form the detergent composition.

2. A process according to claim 1, whrein the calcium carbonate has a surface are of from about 30 to about 100 m²/g.

3. A process according to claim 1, wherein the calcium carbonate has not been dried before it is incorporated into the detergent slurry.

4. A process according to claim 1, comprising the step of adding to the detergent slurry sodium toluene sulphonate, coconut monoethanolamide or a condensation product of nine moles of ethylene oxide with a linear secondary alkanol containing 11 to 15 carbon atoms as a slurry viscosity decreasing additive, in an amount of from about 0.5% to about 5.0% by weight of the composition.

5. A process according to claim 1, comprising the step of adding to the detergent slurry after the calcium carbonate from about 5 to about 15% by weight of sodium alkaline or neutral silicate, based on the final composition.

* * * * *